United States Patent [19]

Fuller et al.

[11] Patent Number: 4,472,610

[45] Date of Patent: Sep. 18, 1984

[54] KEYBOARDS INCORPORATING KEYS PIVOTABLE AGAINST BIASED DETENT MEANS TO OPERATE ELECTRICAL SWITCHES

[75] Inventors: Maurice D. Fuller, Winchester; David B. Joyce, Southampton, both of England

[73] Assignee: LRE Relays & Electronics Limited, Hampshire, England

[21] Appl. No.: 477,414

[22] Filed: Mar. 21, 1983

[30] Foreign Application Priority Data

Mar. 25, 1982 [GB] United Kingdom ..... 8208765

[51] Int. Cl.[3] ..... H01H 9/20; H01H 23/02

[52] U.S. Cl. ..... 200/5 A; 200/339; 200/323; 200/291; 200/308; 200/315

[58] Field of Search ..... 200/311, 315, 317, 339, 200/305, 302, 323, 324, 325, 291, 5 A, 264, 153 T, 339, 308

[56] References Cited

U.S. PATENT DOCUMENTS

| | | | |
|---|---|---|---|
| 2,817,721 | 12/1957 | Edwards | 200/291 |
| 3,155,806 | 11/1964 | Klingenberg | 200/315 |
| 3,225,156 | 12/1965 | Sahrbacker | 200/339 X |
| 3,482,542 | 12/1969 | Mace | 200/317 X |
| 4,024,362 | 5/1977 | Morgan et al. | 200/339 X |
| 4,096,364 | 6/1978 | Lynn et al. | 200/5 A |
| 4,191,873 | 3/1980 | Woodard | 200/302 |
| 4,259,551 | 3/1981 | Ohtani et al. | 200/5 A |
| 4,324,956 | 4/1982 | Sakakino | 200/302 X |

*Primary Examiner*—Stephen Marcus
*Assistant Examiner*—Ernest G. Cusick
*Attorney, Agent, or Firm*—Pearne, Gordon, Sessions, McCoy, Granger & Tilberry

[57] ABSTRACT

A keyboard, particularly for control of electronics in vehicles, has at least one key mounted in a recess in the keyboard and pivotable about a pivot to press against a shaped portion of a rubber gasket to operate an electrical switch. A display, preferably a multiple character LCD, for labellingthe switch is visible through a transparent member and connected to a p.c.b. by zebra striped members. The display is not obscured by a finger operating the key. The key has a transverse bore in which a compression spring is mounted with balls at the end of the spring to co-operate with stepped generally cylindrical members mounted with their axes perpendicular to the pivot pin and forming detent means to give the key a tactile operation. Preferably the key operates three switches by way of three shaped portions.

9 Claims, 19 Drawing Figures

KEYBOARDS INCORPORATING KEYS PIVOTABLE AGAINST BIASED DETENT MEANS TO OPERATE ELECTRICAL SWITCHES

The invention relates to keyboards and particularly, though not exclusively, to keyboards which comprise a plurality of illuminated keys for use in vehicles.

In vehicles, particularly though not exclusively military vehicles, it is frequently necessary for the driver or pilot, in the darkened interior of the vehicle or a cockpit thereof, to identify, locate and operate a particular control and to receive a feedback indicating that the control has in fact actually been operated. A wide variety of panels incorporating illuminated push buttons with tactile feedback have been proposed and widely used in specialist applications. To enable reliable operation to be achieved in vehicles subjected to sudden movements and to avoid inadvertent operation, ergonomic push buttons or keys requiring a considerable pressure to operate them have been provided in the form of keyboards in flat panels usually with the push buttons or keys projecting from the flat panels to assist location by the operator.

U.S. Pat. No. 4,088,855 shows an ergonomic push button mounted to project beyond the surface of a panel, the push button having a lamp mounted beneath its center to illuminate identification data engraved in the push button and having a toroidal garter spring which is stressed on operation of the push button thereby to give a tactile indication to the operator. While generally satisfactory, such an arrangement has a number of disadvantages in that a garter spring, if strong enough to give a good tactile feedback, tends to have only a short life. The location of a finger of the operator on the push button may be difficult particularly if the operator is wearing gloves and once the finger of the operator is located on the push button the illuminated data engraved thereon is obscured from view.

As a result of increased provision of electronic equipment in vehicles and the consequent increased requirements for controls and data displays for the electronic equipment and with advances in electronic circuitry, it has been proposed that a single control panel and data display be used for several functions according to the mode into which the control panel and data display is switched. Thus, a single control panel and data display in a first mode could be used for the pre-flight checks on an aircraft, in a second mode could be used for in-flight navigation and in a third mode could be used as a bomb discharge control. In such multiple use the push buttons of the control panel cannot have data permanently engraved thereon since the data would be inappropriate in all but one of the modes.

By providing light emitting diodes or liquid crystal displays, preferably in a seven by five, that is to say a thirty-five dot, matrix, it is possible to provide any illuminated letter, numeral or other character in the ASCII series. Thus, by providing one or two or more of the matrices for each push button, it is possible to provide data for that push button appropriate to the mode to which the control panel is switched. Such proposal however requires the provision of a very large number of electrical connections and, in the case of the LED embodiment, necessitates the ability to dissipate a considerable quantity of heat. In addition, if the display and the push button move together, there is the problem of providing flexible connections for all of the electrical connections but if only the push button is to move and the display is to be stationary then parallax problems are likely to arise.

The invention has among its objects to provide a keyboard which mitigates at least some of the disadvantages of existing keyboards.

According to the invention there is provided a keyboard incorporating at least one key pivotably mounted in a recess in the keyboard and operable to cause it to move about a pivot axis substantially parallel to the face of the keyboard to operate an electrical switch, against the bias of detent mens, wherein the detent means comprises at least one spring loaded member projecting from the key and co-operating with a profiled portion of a side wall of the recess or a profiled member located in the side wall of the recess or a converse arrangement in which the profiled portion is provided on the key and the spring loaded member projects from the side wall of the recess.

Preferably, the detent means comprises a compression spring mounted in a transverse bore in the key extending parallel to the pivot axis of the key with one of two balls mounted in each end of the bore and biased outwardly by the force of the compression spring, each of the two balls co-operating with a respective profiled member. Advantageously the profiled members are stepped and/or sloped generally cylindrical members mounted with their longitudinal axes perpendicular to the pivot axis of the key and advantageously one such profiled member is provided between two adjacent keys such that one ball of each of the two adjacent keys co-operates with the respective side of the profiled member opposite to the side with which said one ball of the adjacent key co-operates.

A plurality of aligned laterally spaced keys may be mounted to pivot on a single spindle which extends through all of the keys. At least a part of the bottom wall of the recess can be formed by a transparent member, through which transparent member a display for labelling the key and provided beneath the transparent member, is visible, the display being so located that in all positions of the key it is not obscured by the key. Preferably the display comprises LED or LCD matrices.

The transparent member can be a flexible plastics film which may be of a conductive nature to provide screening to prevent electro-magnetic interference. The sheet of flexible plastics film may be deformed at a position over the switch into a bellows form so that the plastics film can also be used to seal the switch against the ingress of moisture or contamination.

Preferably however at least a further part of the bottom wall of the recess is formed by a sheet of elastomeric material having an aperture therein to permit the display to be viewed, the sheet incorporating at least one shaped portion to transmit pressure applied to the key to an operating member of the or the respective electrical switch.

The shaped portions are preferably spherical. Particularly where LED matrices are used, they can be provided on a portion of the panel having good heat conductance whereby such portion can conduct heat away from the display and thereby prevent overheating. The display can be stationarily mounted whereby electrical connection problems are not severe.

The key may have a projecting portion incorporating a filter to prevent light reflection or the filter may be formed by the transparent member and be stationary. The filter member can lie in close proximity to the display whereby undue parallax problems can be avoided.

If desired, the key may be effective when depressed to operate a plurality of switches, which switches can, if desired, be connected in such a way that failure of one of the switches will not prevent the necessary contact being made when the key is depressed. Where the switches are operated by shaped portions of a sheet of elastomeric material, one of the shaped portions is provided for each respective switch.

The force of the spring biasing the balls of the detent means outwardly will be chosen according to the operating force required for the key.

Advantageously the keyboard comprises an outer cover plate portion in which the key is pivotably mounted and a lower frame portion clamped to the cover plate portion with the sheet of elastomeric material therebetween, the lower frame portion having apertures therein with the switches and display mounted therein and connected to respective printed circuit boards.

Where the display is an LCD, the connection thereof to the respective printed circuit board is preferably effected by piece of material comprising alternating layers of electrically conducting and non-conducting elastomer clamped between the display and the printed circuit board.

A keyboard according to the invention can be located in very close proximity to other members. Particularly keys of a keyboard according to the invention can be located virtually touching an edge of a cathode ray tube and preferably with the pivot axis of the keys parallel to that edge such that they can readily be identified with a particular respective position on the cathode ray tube at which a display is provided relevant to a control provided by the respective key.

If desired, the key can control two switches located on opposite sides of the pivot axis of the key such that one switch is operated when the key is in a raised position and the other switch is operated when the key is in a depressed position. If desired, the key may have a latching effect, that is to say it can be bi-stable by arranging for the ball or balls of the detent means to move over an edge or a point during movement of the key.

The invention is diagrammatically illustrated by way of example in the accompanying drawings, in which.

Figure 4:
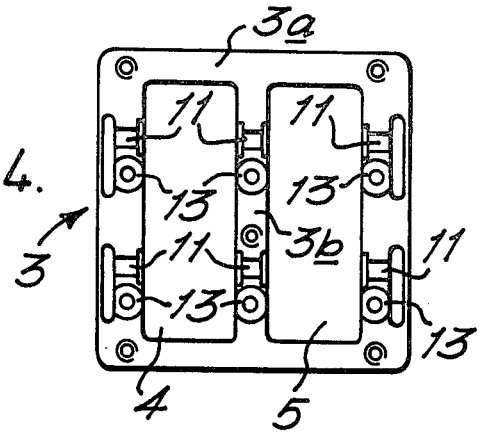
FIG. 4 is an elevation of the rear face of a frame member of the keyboard of FIGS. 1 to 3.
Figure 3:
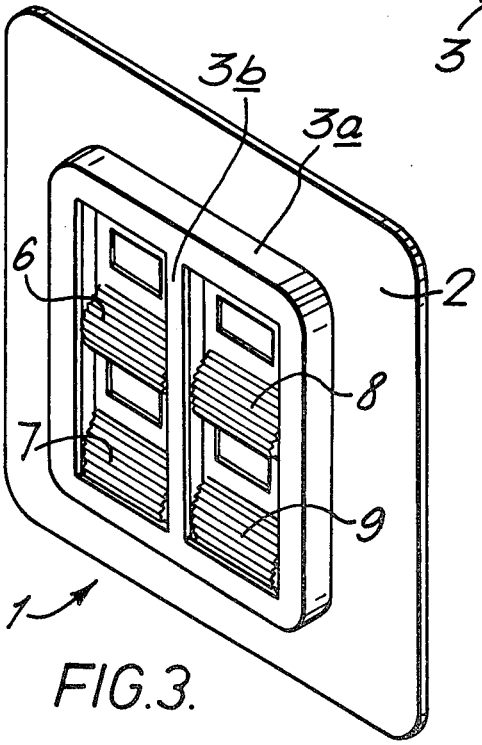
FIG. 3 is a perspective view corresponding to FIG. 1.
Figure 5:
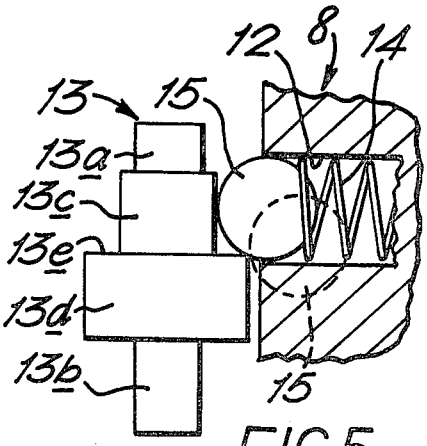
FIG. 5 is a view to a greatly increased scale of detent means of a key of a keyboard according to FIGS. 1 to 3.

Referring to the drawings and firstly to FIGS. 1 to 5, a keyboard 1 mounted on a panel 2 has a frame member 3 comprising a rectangular peripheral portion **3*a* and a center divider 3*b*. The frame members 3*a* and 3*b* define two recesses 4 and 5 in each of which two keys are mounted, that is to say keys 6 and 7 in the recess 5 and keys 8 and 9 in the recess 4. Each key 6 to 9 is identical with the others and therefore only the construction of key 8 is described. As can be seen from FIG. 2, the key 8 has a transverse bore 10 therein through which a spindle passes, the spindle being engaged in loose bearing bushes 11 located in recesses in the rear face of the frame member 3 and in fact the spindle being long enough to mount also the key 6. Below the bore 10 for the spindle, as viewed in FIG. 2, an actuating portion 8*a* of the key is provided and above the spindle 10 a transparent portion 8*b* is provided. In the portion 8*a*, a transverse bore 12 is provided and receives, as shown in FIG. 5, a compression spring 14 and at each end of the compression spring a respective steel ball 15, the length of the spring being such that the spring presses the balls 15 outwardly beyond the ends of the transverse bore 12. The balls 15 co-operate with profiled members 13, shown greatly enlarged in FIG. 5, the profiled members 13 each comprising an upper end bearing portion 13*a*, a lower end bearing portion 13*b* and, between the portions 13*a* and 13*b*, two portions 13*c* and 13*d* which are of different diameters such that there is a shoulder 13*e* therebetween. The profiled members 13 are located as shown in FIG. 4 with the upper end bearing portions 13*a* received in bores in the frame member 3 and the lower end bearing portions 13*b* received in bores in the panel 2. The profiled members 13 are so disposed that in a rest position of the keys 6 to 9, the balls 15 in the ends of the bores 12 are engaged against the portion 13*c* of the profiled members 13 as shown in FIG. 5. If pressure is applied to the actuating portion 8*a* of the key 8 in a sense to press it towards the panel 2 (downward movement as viewed in FIG. 5), the key 8 will pivot about the spindle in the bore 10 and the balls 15 in the ends of the bore 12 will ride over the shoulder 13*e* partly but not completely onto the portion 13*d* thereby being moved inwardly into the bore 12 against the force of the compression spring 14 to the position shown in dotted lines in FIG. 5**. The resultant stressing of the compression spring gives a very noticable tactile feedback to the operator of the key.

Figure 1:
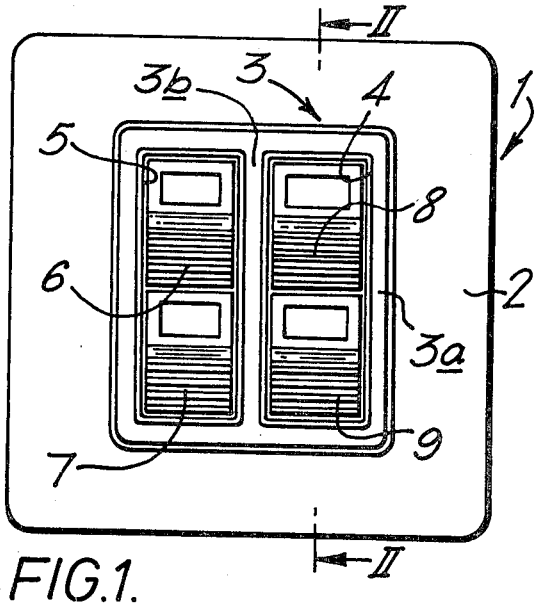
FIG. 1 is an elevation of a first embodiment of keyboard according to the invention incorporating four keys.
Figure 2:
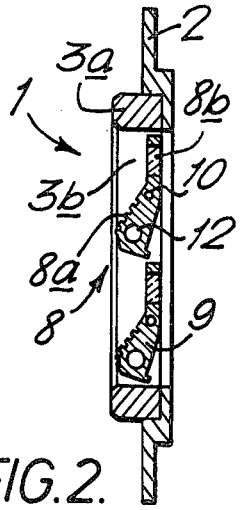
FIG. 2 is a sectional view taken on line II—II of FIG. 1.
Figure 6:
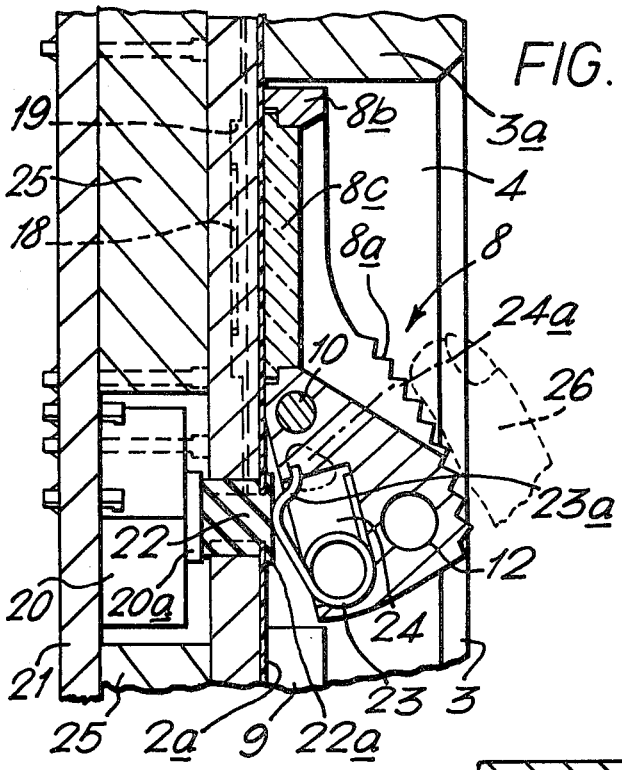
FIG. 6 is a fragmentary sectional side view through a keyboard according to the invention having a top plate as shown in FIGS. 1 to 4.

Referring to FIG. 6, the key 8 is shown in greater detail and like parts to those shown in FIGS. 1 to 5 are indicated by the same reference numerals however the key 8 is viewed in section from the other side compared with FIG. 2. The portion 8*b* comprises a peripheral frame with a filter 8*c* secured therein. Between the panel 2 and the frame 3 is a sheet 2*a* of plastics, advantageously plastics sheet of the kind sold under the trade mark Cobex; this is preferably polyester film with a gold coating which while allowing approximately 68% light transmission provides electro-magnetic interference screening. A display, preferably two or more light emitting diode (LED) matrices 18 are provided in a recess 19 in the front face of the panel 2 beneath the filter 8*c* such that when illuminated it can be viewed through the filter 8*c*. The filter 8*c* prevents light reflection. Mounted behind the actuating part 8*a* of the key 8 is an electrical switch 20 which is mounted on a printed circuit board 21, an actuating member 20*a* of the switch 20 co-operating with a rubber bush 22 which extends through an aperture in the panel 2 and an aperture in the sheet 2*a* and has a flange 22*a* on the outer side of the sheet 2*a* to effect sealing. A torsion spring 23 is mounted in a recess 24 in the rear face of the actuating part 8*a* of the key 8 and has an arm 23*a* which in the rest position of the key 8 shown rests lightly against the rubber bush 22 but with insufficient force to actuate the switch 20. The panel 2 is secured to a frame 25 and particularly a portion of the frame 2 behind the display 18 is in intimate contact with the frame 25 such that the frame 25 acts as a heat sink for heat produced in the display 18. The printed circiuit board 21 is also mounted on the frame 25. To operate the key 8, the operator can relatively easily locate a finger on the actuating portion 8*a* by engaging the finger in the recess 4 and then moving it onto the portion 8*a* to the position indicated in broken lines at 26 in FIG. 6. It will be seen that the finger in the position 26 does not obscure the filter 8*c* and thus does not obscure the display 18 visible therethrough. Application of force to the actuating portion 8*a* will cause the arm 23*a* of the spring 23 to actuate the actuating member 20*a* of the switch 20 but the free end of the arm 23*a* is free to move within a recess 24*a* in the actuating part 8*a* and thus the force which can be applied to the actuating member 20*a* of the switch 20 by the key 8 is limited by the torsion force of the spring 23.

If desired a back-illuminated liquid crystal display (LCD) could replace the LED matrices of the display 18 but a heater would then be required in some applications to enhance performance at low temperatures.

Figure 7:
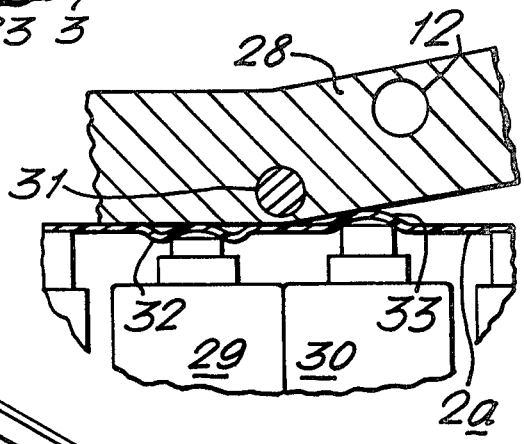
FIG. 7 is a fragmentary sectional side view of a second embodiment of a keyboard according to the invention.

FIG. 7 shows that a modified key 28 can co-operate with two switches 29 and 30 located on opposite sides of a spindle 31 about which the key 28 is pivotable and that the sheet 2*a* can be provided with bellows portions 32 and 33 over the switches 29 and 30 respectively to avoid having to provide an aperture in the sheet and the rubber bush 22 of FIG. 6.

Figure 8:
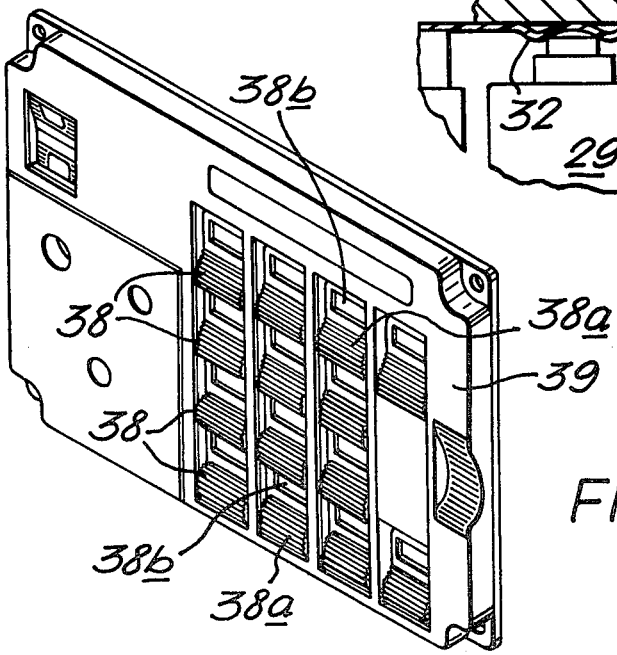
FIG. 8 is a perspective view of a third embodiment of a keyboard according to the invention.

FIG. 8 shows a further embodiment of a keyboard, showing that more than two, four as shown, keys 38 can be provided in a recess. The recesses here are provided to extend below the face of a panel 39 rather than within a surrounding frame as in the previously described embodiments.

If desired the keys can be inverted from the orientation shown, that is to say actuating parts 38*a* of the keys can be provided above instead of below transparent portions 38*b* thereof which extend over the respective display. Other orientations are of course possible and particularly the keys can be mounted about vertical pivot axis, for example, closely along-side a side edge of a cathode ray tube on which an indication relevant to an operation controlled by the key can be displayed at a position closely adjacent the key. The panels may be mounted in any orientation, for example in a horizontal orientation in an overhead surface with the keys on the underside.

The detent arrangement provided by the compression spring, the balls and the profiled members can give a high actuation force for the key, good tactile feedback and long life. Preferably the detent arrangement provides a return movement spring force where the key is not a latching key or a rocker switch type key of the kind shown in FIG. 7.

The sheet of plastics 2*a* can seal the switch 20, display 18 and printed circuit board 21 against ingress of dust and water, as well as providing electro-magnetic interference screening.

If desired, the transparent portion 8*b*, 38*b* of the key 8 can be omitted and the filter 18 be stationarily mounted.

If a wide key is used, the bore 12 may be formed by two blind bores each provided with a spring and ball.

Instead of the keys applying a mechanical actuating force to the switches, a proximity sensing arrangement could be used, for example utilizing the Hall effect.

Figure 9:
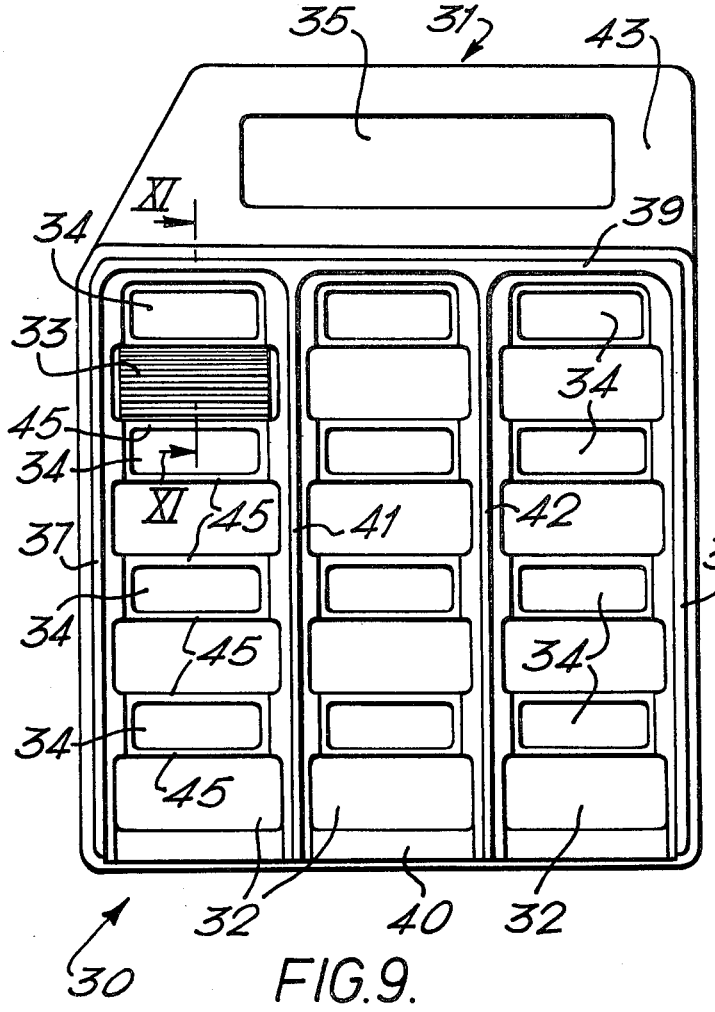
FIG. 9 is an elevation of a fourth embodiment of a keyboard according to the invention.
Figure 10:
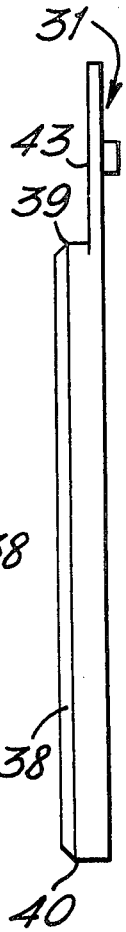
FIG. 10 is a side view corresponding to FIG. 9.

Referring to FIGS. 9 to 19, a keyboard 30 has a top plate 31, FIGS. 9 and 10, with three recesses 32 in its face, each recess 32 having four keys 33 mounted therein although only one is shown in FIG. 9. Above each key 33 is a respective display area 34 and a master display area 35 is provided at an upper part of the keyboard 30. The master display area may, for example, display data indicating the mode in which a multi-mode keyboard is in at any particular time. Each respective display area 34 may be 20.7 mm wide and 8.4 mm high and can display three characters in the ASCII series.

Figure 11:
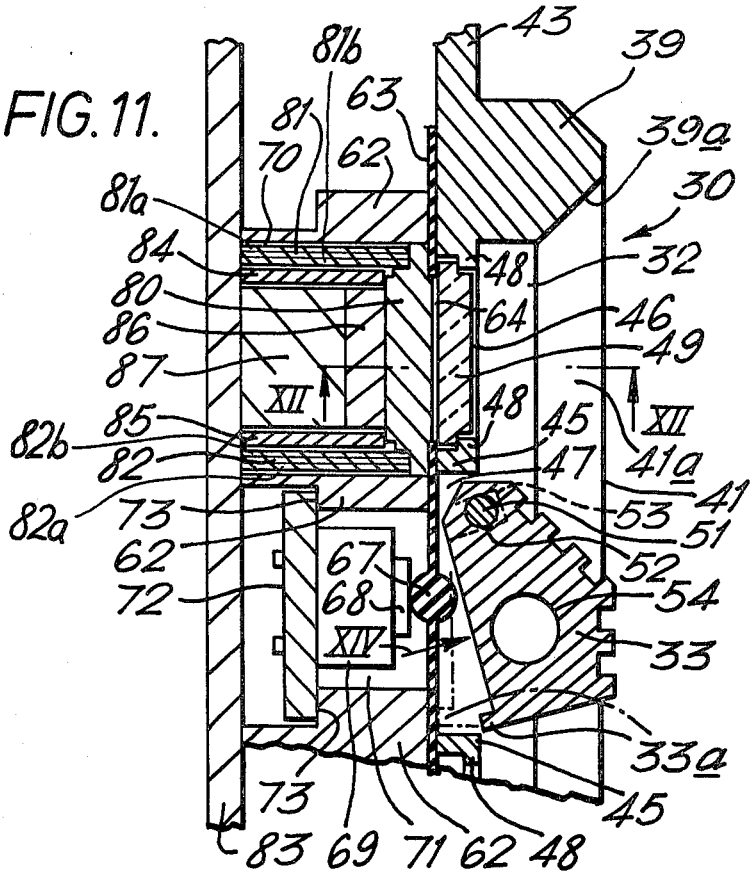
FIG. 11 is a sectional side elevation taken on line XI—XI of FIG. 9.
Figure 12:
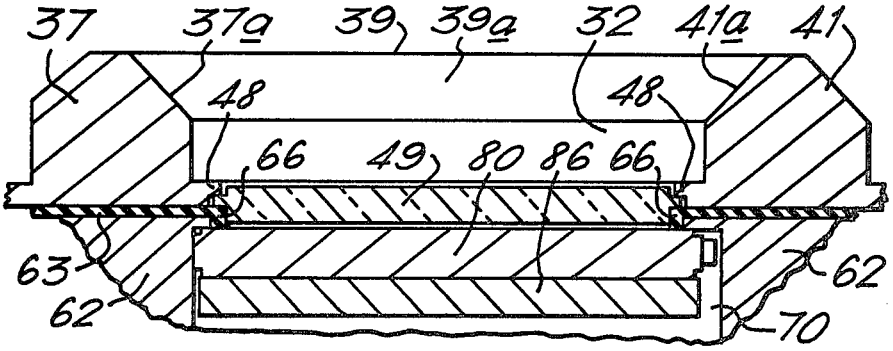
FIG. 12 is a sectional view taken on line XII—XII of FIG. 11.

With particular reference to FIGS. 11 and 12, the top plate 31 has vertical frame members 37 and 38, horizontal frame members 39 and 40 and vertical dividing members 41 and 42 all projecting outwardly from a plate portion 43 and defining the three recesses 32.

Each recess 32 is divided up by transverse members 45 of the top plate to form for each key 33 an aperture 46 forming the respective display area 34 for that key and an aperture 47, below the respective aperture 46. The top plate 31 is thus of apertured grid formation. Each display aperture 46 has lip portions 48 of the frame members 37, 38, 39, 40, dividing members 41, 42 and transverse members 45 to form a rectangular frame into which a transparent window member 49 can be pressed from the rear. The window member 49 is preferably formed of Perspex polished on both sides.

Each key 33 is formed as a pivoted key member mounted on a transverse pivot pin 51. The pin 51 is preferably common to three keys 33, one in each of the three recesses 32, and passes through a bore 52 in each key member 33, a groove 53 being milled in the rear of the key member 33 at a middle portion thereof to avoid the need to drill a long small diameter bore. Each key member 33 also has a transverse bore 54 therein to receive a compression spring 55 and at each end a detent ball 56.

Figure 13:
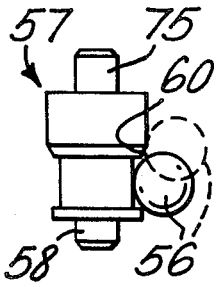
FIG. 13 is an enlarged view showing co-operation of detent balls with a profiled member in the keyboard of FIGS. 9 to 12.
Figure 14:
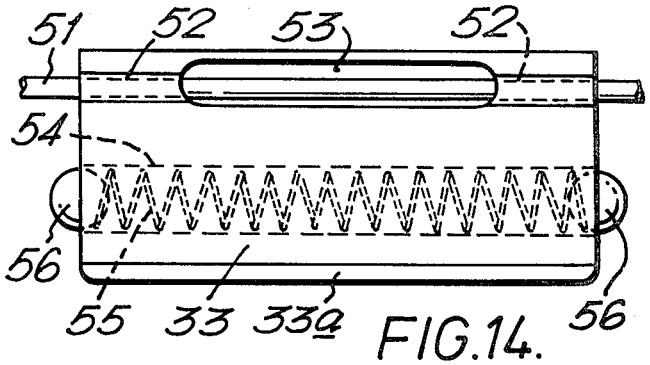
FIG. 14 is a rear view, taken in the direction of arrow XIV of FIG. 11, showing the detent balls mounted in a key member.

The detent balls 56 co-operate with profiled members 57 of stepped cylindrical form as shown in FIG. 13.

Figure 15:
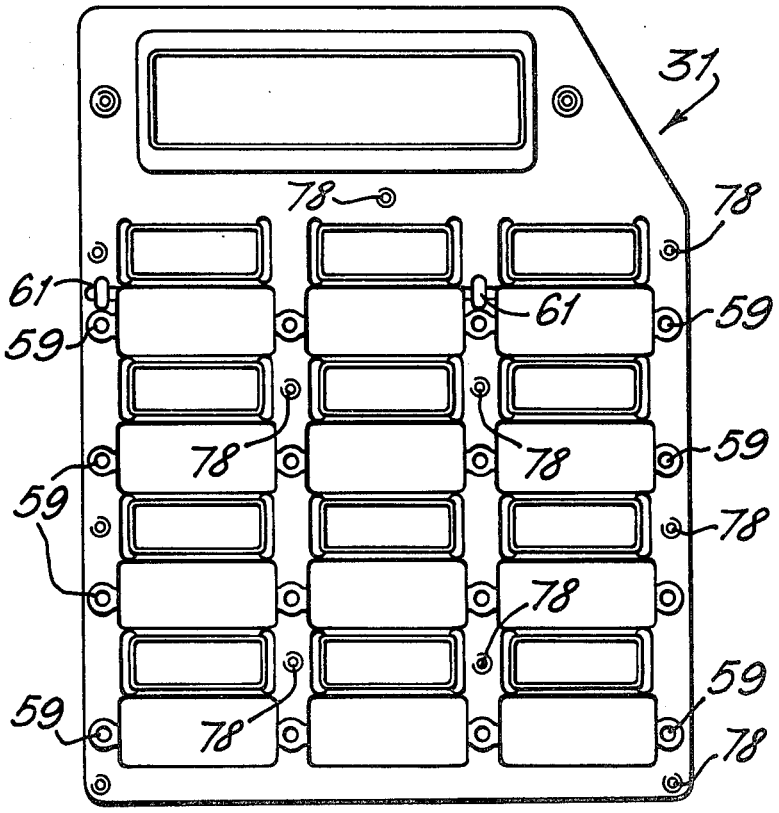
FIG. 15 is an elevation of the rear face of a cover plate of the key board of FIGS. 9 to 14.

Each profiled member 57 is mounted by its outer end 58 in a respective blind bore 59, FIG. 15, in the top plate 31 and in a rest position of the respective key 33 the detent balls are in the upper position shown in FIG. 13. Depressing the key 33 (upward movement as viewed in FIG. 13) causes the ball 56 to move over a sloped shoulder 60 of the member 57 to the upper, dotted line position shown, the spring 55 being compressed by such movement. Thus the ball 56 initially has a three point contact with the profiled member 57 and, due to the slope of the shoulder 60 and the curved face of the ball there is sufficient vector force originating from the spring 55 to move the ball 56 back to its initial position and thus return the key member to its initial position when the key is released from its fully depressed position set by a stop 33*a* on the key member 33.

FIG. 15 shows recesses 61 for receiving bearing bushes for the pivot pins 51 in like manner to the bearing bushes 11 of FIG. 4 and so not described again in detail.

Figure 16:
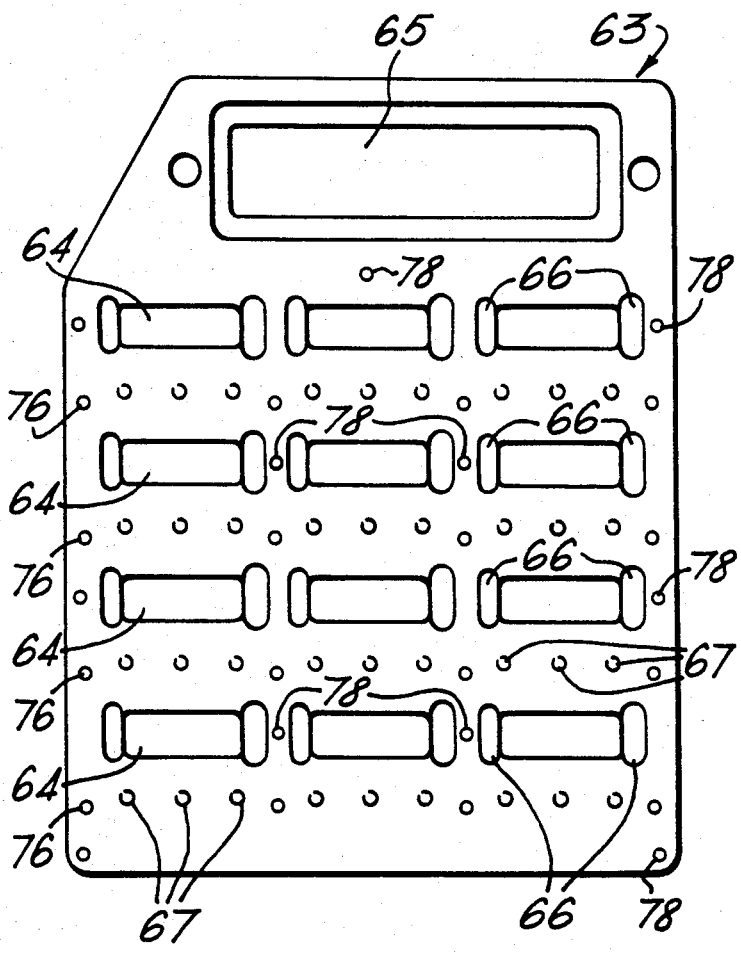
FIG. 16 is an elevation of a gasket member of the keyboard of FIGS. 9 to 15.
Figure 17:
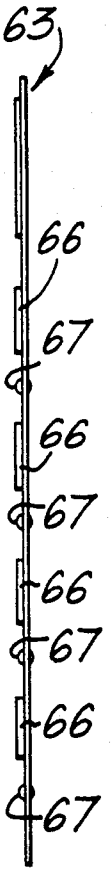
FIG. 17 is a side view corresponding to FIG. 16.
Figure 18:
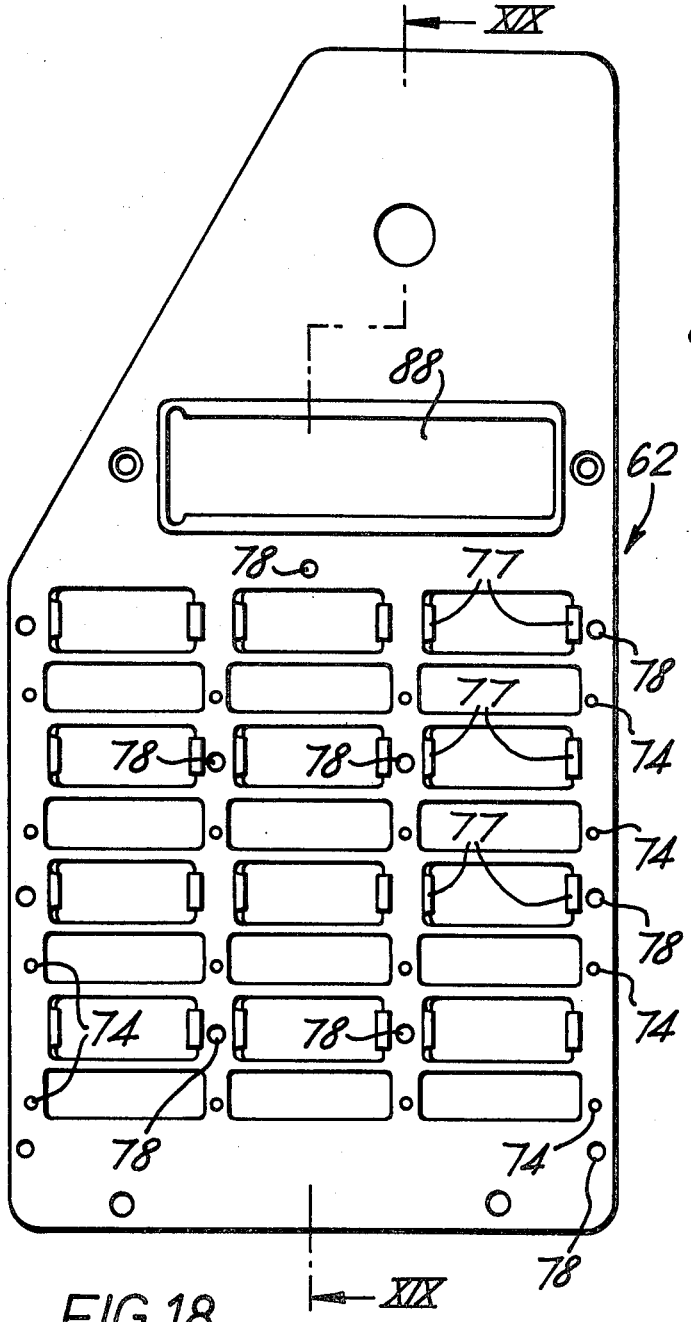
FIG. 18 is an elevation of a body member of the keyboard of FIGS. 9 to 17.
Figure 19:
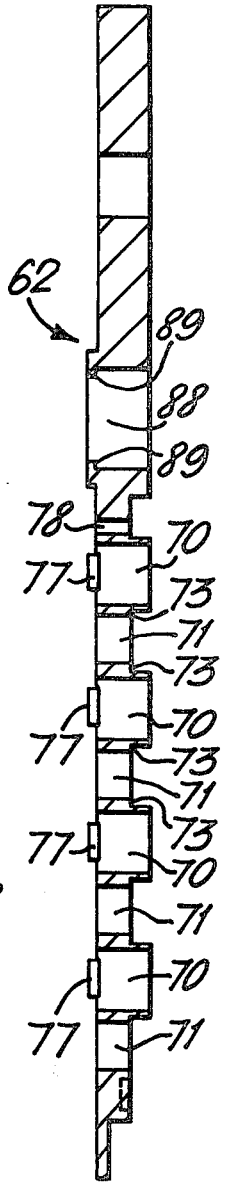
FIG. 19 is a sectional side view taken on line XIX—XIX of FIG. 18.

Between the top plate 31 of FIGS. 9, 10 and 15 and a body member 62 shown in FIGS. 18 and 19, a silicone rubber gasket member 63 is provided. The gasket member is shown in FIGS. 16 and 17 and also in FIGS. 11 and 12. The gasket member 63 has apertures 64 therein corresponding to the display area apertures 46 in the top plate 31, and an aperture 65 aligned with the master display area 35. At the lateral sides of each aperture 64 the gasket member 63 has shaped sealing members 66 which can be seen in FIG. 12.

The gasket member 63 does not have apertures corresponding to the apertures 47 in the top plate 31 behind the key members 33 but has shaped portions 67. As shown the shaped portions 67 are spherical and three are provided behind each key member 33. Each shaped portion 67 co-operates with the operating member 68 of a respective electrical switch 69 only one of which can be seen in FIG. 11. The three switches 69 are provided side-by-side for each key member 33 and, when the respective key member 33 is depressed, are simultaneously operated each by a respective one of the shaped portions 67 of the gasket member 63 pressing against the operating member 68 thereof. The shaped portions 67 do not merely transmit the movement of the key member 33 but rather they modify the movement since they are formed of silicone rubber and thus are deformed when pressure is applied thereto. By choosing a suitable shape for the shaped portions 67 the extent by and manner in which they modify the movement of the key member 33 can be chosen to alter the tactile feel of the operation of the key member 33 in conjunction with the tactile feel obtained by the movement of the detent balls 56 over the shoulders 60 of the profiled members 57 to compress the spring 55. Thus a shaped portion 67 of diamond form, for example, would initially deform more easily than a spherical shaped portion 67 and would thus need a greater movement of the key member 33 but a lower applied pressure compared with the spherical shaped portion 67. The desired feel for the key operation is a high initial resistance followed by a sudden almost total collapse of resistance upon operation.

The body member 62 shown in FIGS. 18 and 19 is also of apertured grid formation and has a respective aperture 70 for each display area 34 and a respective aperture 71 for each key member 33.

The switches 69 are mounted on printed circuit boards 72 and the boards 72 are secured against shoulders 73 in the apertures 71 of the body member 62 as shown in FIG. 11.

The body member 62 also has blind bores 74 to receive lower end portions 75 of the profiled members 57, the lower end portions 75 passing through apertures 76 in the gasket member 63. Upstanding portions 77 of the body member 62 co-operate with the shaped portions 66 of the gasket member 63.

Aligned bores 78 in the body member 62 and the gasket member 63 and screw threaded blind bores 78 in the top plate 31 are provided to receive clamping screws to clamp these three components together.

Referring to FIG. 11, an LCD unit 80 is provided in each aperture 70 in the body member 62 and can display three characters in the ASCII series. The characters are visible since one of the apertures 64 in the gasket member 63 is located outwardly of each unit 80 and the aligned window member 49 is transparent. The frame members 37, 38, 39, 40 and dividing members 41 and 42 have bevelled edges within the recesses 32 as shown at 39*a*, 41*a* in FIG. 11 and 37*a*, 39*a* and 41*a* in FIG. 12 and this gives a 60° cone of viewing angle for the LCD unit 80 assisted by some refraction in the transparent window member 49. The key member 33 has its outer face sloping at a similar angle to the bevelled edges of the frame and dividing members so as not to unduly restrict the viewing angle of the LCD unit 80.

Each LCD unit 80 co-operates with two electrical contact members 81, 82 each formed by alternating laminations of electrically conductive and non-conductive elastomer 81*a*, 81*b* and 82*a*, 82*b*, respectively. Such contact members are available commercially under the designation "zebra stripe". The contact members 81, 82 transmit the necessary electrical signals from an LCD printed circuit board 83 to the LCD unit 80. For a three character display of the LCD, several hundred connections may be required, even when using x–y matrices. The LCD unit 80 is supported by insulating supports 84, 85 and is backed by an electroluminescence back lighting unit 86 and a heater and heater support 87.

LCD units (not shown) to form the master display 35 are located in an aperture 88 in the body member 62 by shoulders 89 thereof and are provided with supports and contact members in similar manner to the LCD units 80.

What we claim is:

1. A keyboard having a front face, a recess in said front face, a side wall in said recess, at least one key mounted in said recess, a pivot axis for said key, said pivot axis extending substantially parallel to said front face of the keyboard, an electrical switch and biased detent means, wherein said key is pivotable about said pivot axis by an operator against the bias of said detent means to operate said electrical switch and wherein a transverse bore is provided in said key extending parallel to said pivot axis of said key and said biased detent means comprises a compression spring mounted in said bore and two balls one mounted in each end of said bore and biased outwardly by the force of the compression spring, each of the two balls co-operating with a respective profiled member located in the side wall of the recess, and comprising a stepped generally cylindrical member mounted with its longitudinal axis perpendicular to said pivot axis of said key.

2. A keyboard as claimed in claim 1, wherein each said profiled member is provided between two adjacent ones of said keys such that one of said balls of each of the two adjacent keys co-operates with the respective side of said profiled member opposite to the side with which one of said balls of the adjacent key co-operates.

3. A keyboard as claimed in claim 2, wherein a plurality of said keys are aligned and laterally spaced and mounted to pivot on a single spindle which extends through all of said keys and defines said pivot axis.

4. A keyboard as claimed in claim 1, wherein said recess has a bottom wall, at least a part of said bottom wall is formed by a transparent member, through which transparent member a display for labelling said key and provided beneath said transparent member is visible, and said display is so located that in all positions of said key it is not obscured by said key, the keyboard includes at least one further electrical switch and wherein each said key is effective when depressed to operate said electrical switch and said at least one further electrical switch.

5. A keyboard as claimed in claim 4, wherein at least a further part of said bottom wall of said recess is formed by a sheet of elastomeric material having an aperture therein to permit said display to be viewed therethrough, said sheet incorporating at least one shaped portion to transmit pressure applied to said key to an operating member of said electrical switch.

6. A keyboard as claimed in claim 5, wherein said shaped portion is spherical.

7. A keyboard as claimed in claim 5, wherein said front face is provided on an outer cover plate portion and said key is pivotably mounted in said cover plate portion and said keyboard further comprises a lower frame portion clamped to said cover plate portion with said sheet of elastomeric material therebetween, said lower frame portion having apertures therein with said switch and said display mounted therein and connected to respective printed circuit boards.

8. A keyboard as claimed in claim 7, wherein said display is an LCD and the connection thereof to the respective said printed circuit board is effected by pieces of material comprising alternating layers of electrically conducting and non-conducting elastomer clamped between said display and said printed circuit board.

9. A keyboard as claimed in claim 7, wherein each said profiled member is a stepped generally cylindrical member mounted with its longitudinal axes perpendicular to said pivot axis of said key and each said profiled member is provided between two adjacent ones of said keys such that one of said balls of each of the two adjacent keys co-operates with the respective side of said profiled member opposite to the side with which one of said balls of the adjacent key co-operates and wherein each said profiled member is mounted with one end thereof located in a bore in said cover plate and the other end thereof passing through an aperture in said sheet and located in a bore in said lower frame portion.

* * * * *